United States Patent [19]

Gotanda

[11] Patent Number: 5,029,912

[45] Date of Patent: Jul. 9, 1991

[54] LOCKING DEVICE

[76] Inventor: Motohiro Gotanda, 1802-10, Nakabiyo, Abiko-shi, Chiba-ken, Japan

[21] Appl. No.: 506,979

[22] Filed: Apr. 9, 1990

[51] Int. Cl.[5] ..... E05C 1/12

[52] U.S. Cl. ..... 292/143; 292/144; 292/254; 292/169.13; 292/341.16; 292/251.5

[58] Field of Search ..... 292/254, 341.16, 143, 292/169.13, 144, 251.5

[56] References Cited

U.S. PATENT DOCUMENTS

| | | | |
|---|---|---|---|
| 3,758,142 | 9/1973 | Gartner | 292/254 |
| 3,829,138 | 8/1974 | Morita | 292/254 |
| 4,355,830 | 10/1982 | Rau, III | 292/254 |
| 4,376,379 | 3/1983 | Gotanda | 70/118 |
| 4,399,673 | 8/1983 | Gotanda | 70/276 |
| 4,529,234 | 7/1985 | Senften | 292/254 |
| 4,679,834 | 7/1987 | Gotanda | 292/169.13 |
| 4,840,050 | 6/1989 | Gotanda | 292/169.13 |

OTHER PUBLICATIONS

Japanese Published Application 1-151669, 6/14/89, Gotanda, pp. 399-406.

*Primary Examiner*—Eric K. Nicholson

*Attorney, Agent, or Firm*—Jordan and Hamburg; Jordan and Hamburg

[57] ABSTRACT

A locking device has a trigger bolt for fastening a dead bolt and can be released by actuating a cooperating assembly placed in a door frame from a remote control room. A lock case placed in a door includes a turnable inner operating element provided with an inside thumb-turn operable from the inside, a turnable outer operating element provided with an outside thumb-turn operable from the outside, a turning lever drivable by the operating element, a dead bolt movable forwards to lock and backwards to unlock by the action of the turning lever, and a locking device for locking the dead bolt in a locking position. The locking device is released by turning the inner operating element in case of unlocking the dead bolt by turning the inner operating element, and the locking device is remotely released so as to allow the movement of turning lever in case of unlocking the dead bolt by using the outer operating element and a fix component assembly placed in a door frame cooperates with the locking mechanism assembly in the door and an electrical device is remotely operable to release the locking device.

10 Claims, 11 Drawing Sheets

LOCKING DEVICE

BACKGROUND OF THE INVENTION

The present invention relates to a locking device wherein a trigger bolt for fastening a dead bolt is provided in said dead bolt and can be released by actuating a cooperating assembly placed in a door frame from remote control room.

Conventional locking devices were provided only with dead bolts that were movable forward and backwards by means of thumb-turns operable from the outside and the inside. In the prior art it was not possible that a dead bolt could be locked and unlocked from the outside by turning an outside thumb-turn only, unless a key were used.

The above-mentioned conventional lock devices had the drawback that it was impossible to lock and release a dead bolt from the outside of a door by means of, for example, only a thumb-turn without the use of a key and a cylinder lock. The addition of a cylinder lock makes the locking device larger in size and higher in cost.

The present invention was made to solve the above-mentioned problem and therefore to provide a lock device wherein the dead bolt of the locking mechanism placed in a door can be locked from the outside and the inside respectively by means of corresponding thumb-turns and also can be unlocked even from the outside by means of only the outer thumb-turn by remotely unlocking the dead bolt from the door frame side.

SUMMARY OF THE INVENTION

It is an object of the present invention to provide a door locking device which is intended to lock and unlock the door from the inside by turning an inside thumb-turn in corresponding directions and also to lock the door from the outside by turning an outside thumb-turn in a locking direction and to unlock the door from the outside by turning the outside thumb-turn in an unlocking direction after remotely actuating a disengaging means in the door's frame for disengaging a trigger bolt.

BRIEF DESCRIPTION OF THE DRAWINGS

FIG. 1 is a sectional side view, with portions cut away, of the embodiment and FIG. 2 is a sectional view taken along line II—II of FIG. 1;

FIG. 3(*a*) is a front view, FIG. 3(*b*) is a view and FIG. 3(*c*) is a partially cut-away, side view;

FIG. 4(*a*) is a front view, FIG. 4(*b*) is a side view and FIG. 4(*c*) is a sectional view taken along line IVC—IVC of FIG. 4(*a*);

FIG. 5(*a*) is a front view and FIG. 5(*b*) is a side view;

DESCRIPTION OF THE PREFERRED EMBODIMENTS

Figure 1:
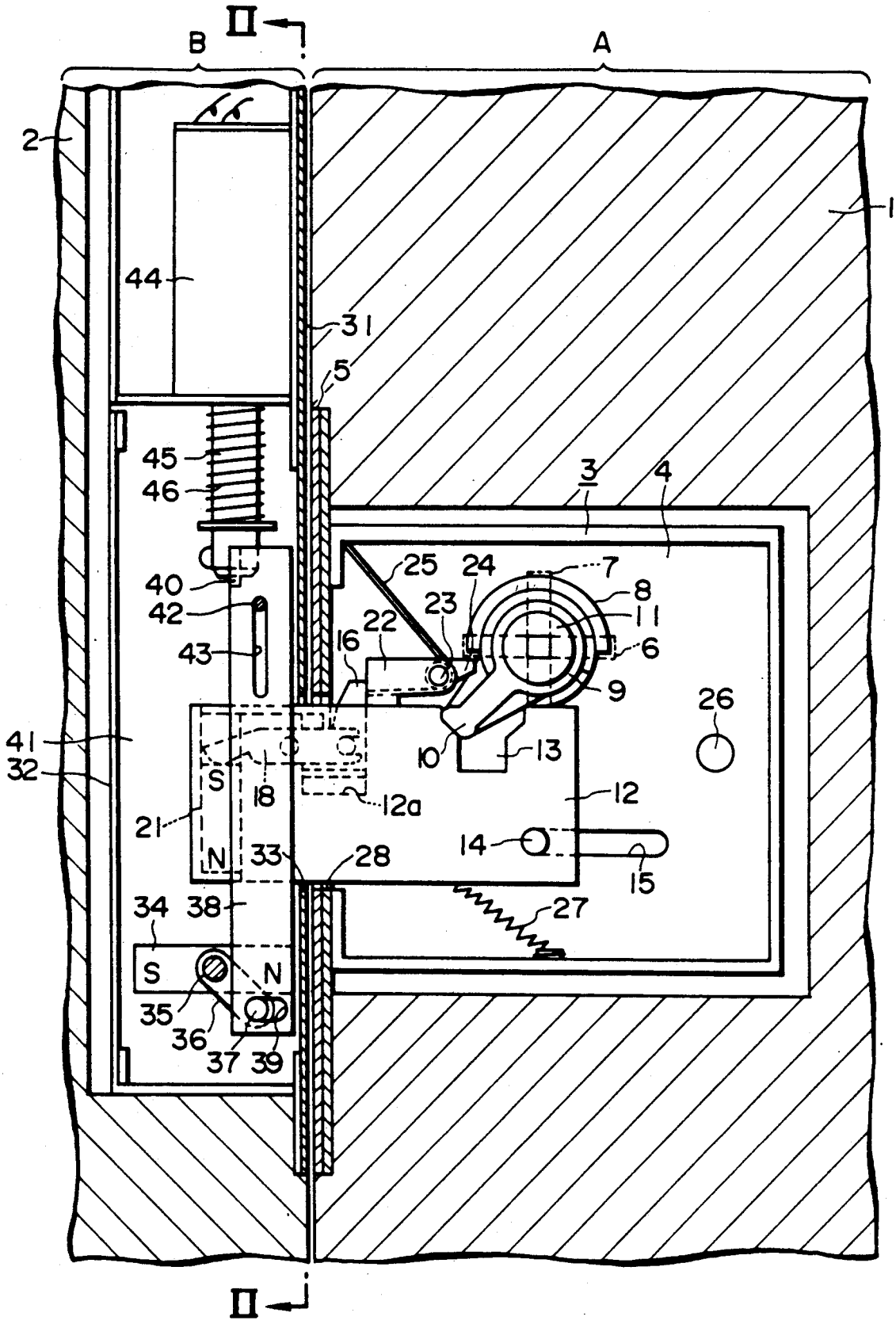
FIGS. 1 and 2 show an embodiment of the present invention.
Figure 2:
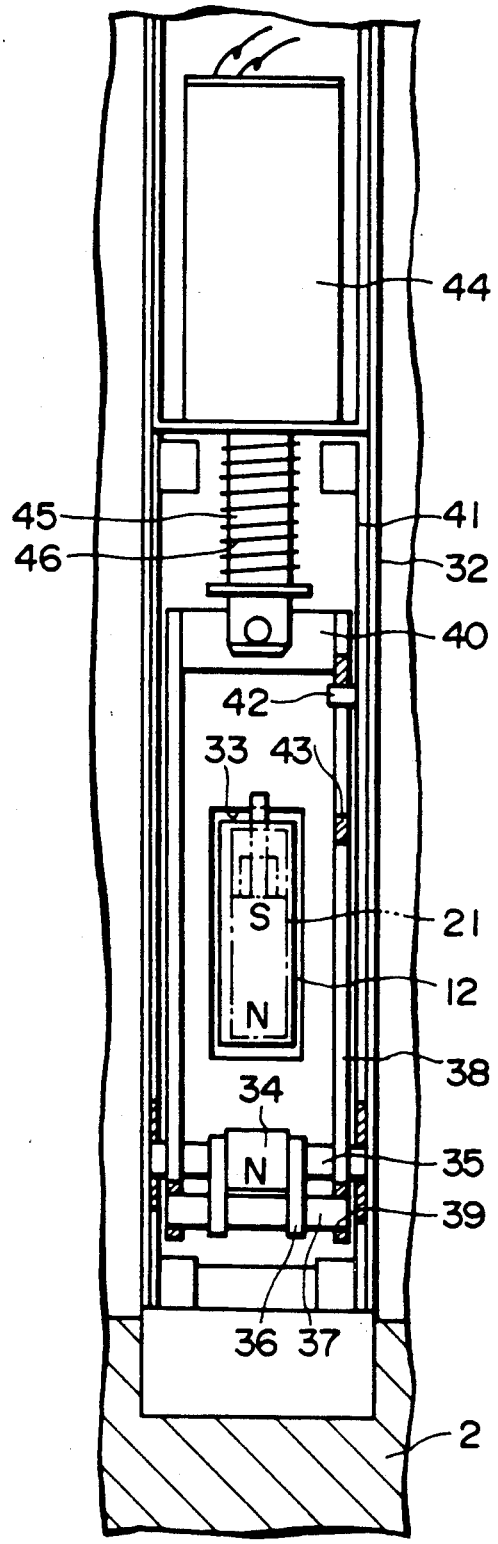
Figure 3A:
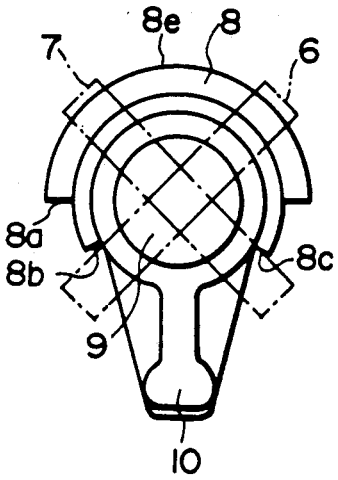
FIGS. 3(*a*), 3(*b*) and 3(*c*) are detailed views of the operating elements shown in FIGS. 1 and 2.
Figure 3B:
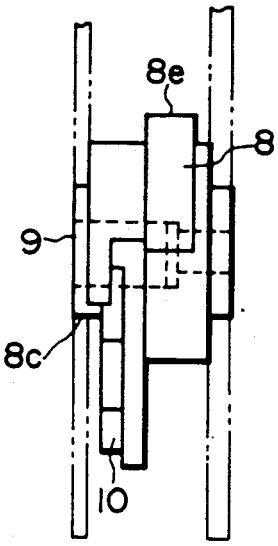
Figure 3C:
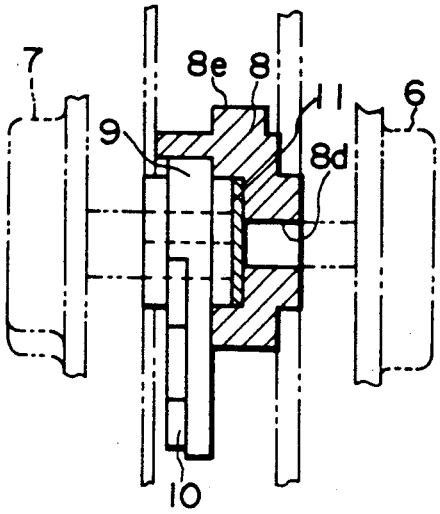

FIGS. 1 and 2 show an embodiment of the present invention: FIG. 1 is a sectional side view, with cut-away portions of the embodiment and FIG. 2 is a cross section taken on line II—II of FIG. 1. FIGS. 3(*a*)–(*c*) are detailed views of operating elements shown in FIGS. 1 and 2: FIGS. 3(*a*) is a front view, FIG. 3(*b*) is a side view and FIG. 3(*c*) is a partially cut-away side view.

In these drawings, A is a locking mechanism assembly placed a door 1 and B is a cooperating component assembly placed in the door's frame 2.

Figure 4A:
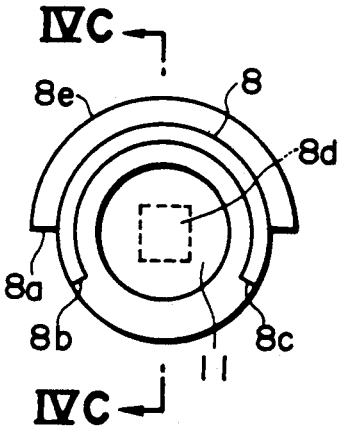
FIGS. 4(*a*), 4(*b*) and 4(*c*) are a detailed view of an inner one of the operating elements shown in FIGS. 3(*a*)–3(*c*)
Figure 4B:
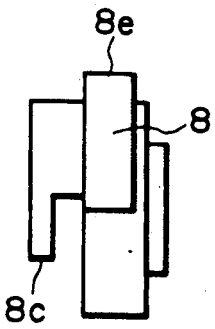
Figure 4C:
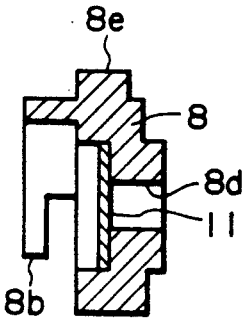

In the locking mechanism assembly A, 3 is a locking mechanism, 4 is a case for the locking mechanism 3 and 5 is a face plate of said case A. In FIG. 1, 6 is an inside thumb-turn (indoor side) and 7 is an outside thumb-turn, 8 is an inner operating element to be turned by means of the inside thumb-turn 6 which will be shown in detail in FIGS. 4(*a*)–(*c*). FIG. 4(*a*) is a front view, FIG. 4(*b*) is a side view, and FIG. 4(*c*) is a cross-section taken on line IVC—IVC of FIG. 4(*a*).

Figures 5A, 5B:
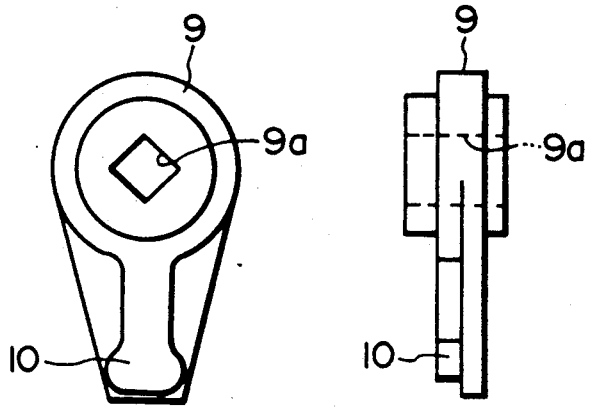
FIGS. 5(*a*) and 5(*b*) are detailed views of an outer one of the operating elements shown in FIGS. 3(*a*) to 3(*c*)

In FIGS. 3(*a*)–(*c*), an outer operating element 9 engaging the inner operating element 8 is turned by means of the outside thumb-turn 7 which will be shown in a detailed views in FIGS. 5(*a*) and 5(*b*). FIG. 5(*a*) is a front view and FIG. 5(*b*) is a side view. 10 is a turning lever formed integrally with the inner operating element and 11 of FIGS. 4(*a*) and 4(*b*) is a partition for preventing an abutment of the thumb-turns' axes. In FIGS. 4(*a*)–(*c*), 8*a* is an engaging part for engaging with the finger of a locking lever (to be described later when the inner operating element 8 is turned), 8*b* and 8*c* are engaging parts for engaging the turning lever 10 when the inner operating element 8 is turned, 8*d* is an opening for mounting the inside thumb-turn 6, and 8*e* is the circumference of the inner operating element 8. In FIG. 5, an opening 9*a* is used for mounting the outside thumb-turn 7.

Figure 12:
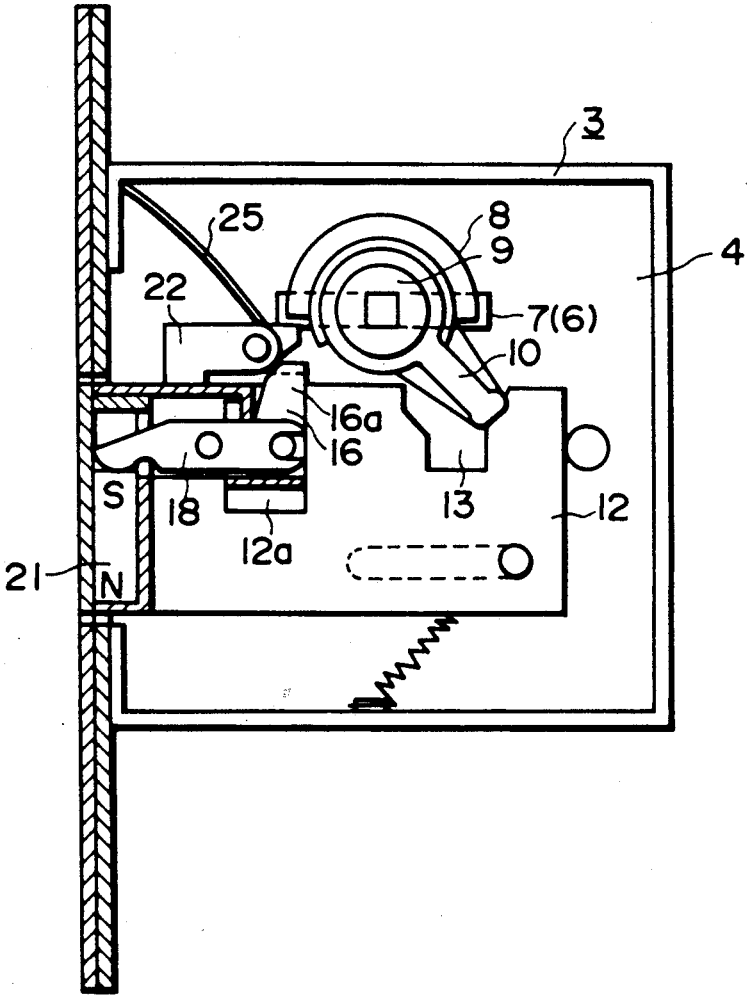

In FIGS. 1 and 2, 12 is a dead bolt, 13 is a groove to be engaged by the turning lever 10. The dead bolt 12 moves forward to lock and backwards to unlock as the turning lever 10 turns in corresponding directions. A guide shaft 14, secured to the dead bolt 12, engages in a guiding ellipse hole 15 formed in case 4 to guide the dead bolt 12. A trigger bolt 16 is slidably fitted at its one end in an engaging groove 12*a* formed in the dead bolt 12 and has a part projecting upward from the dead bolt 12 as shown in detail in FIG. 6.

Figure 6:
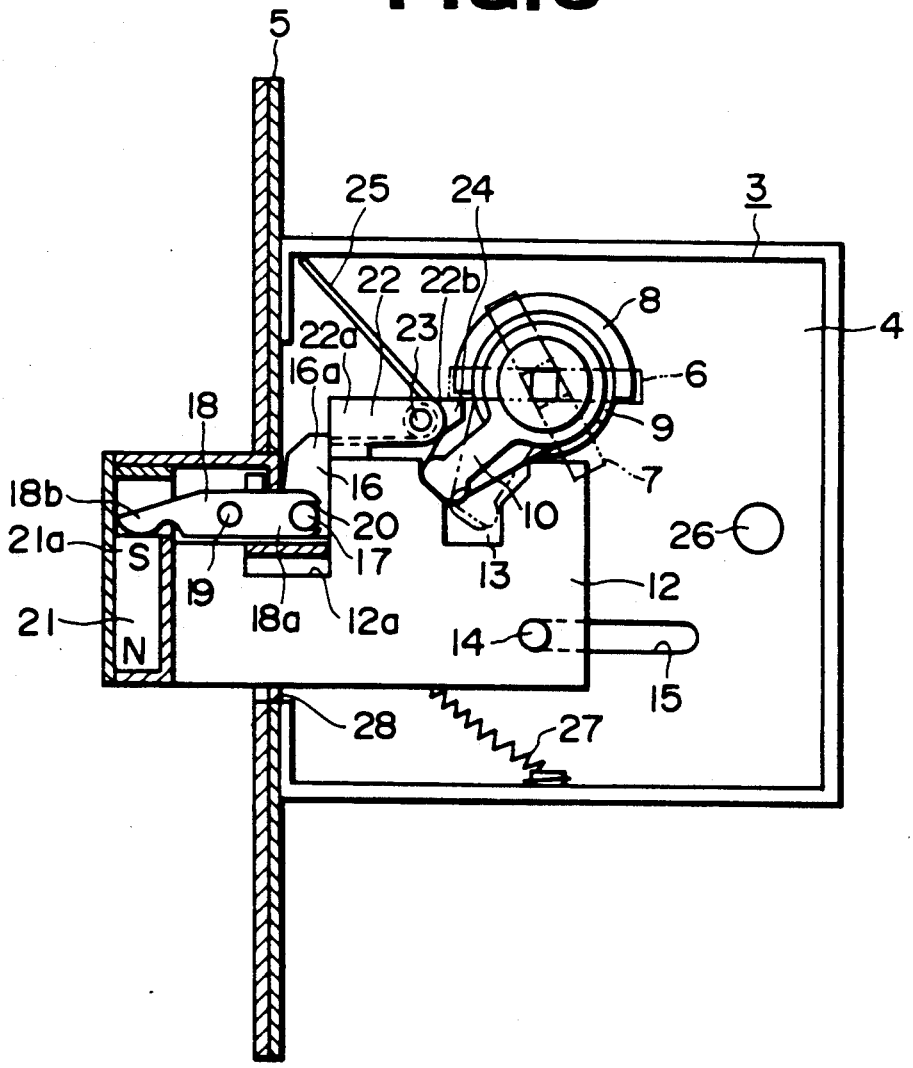
FIG. 6 is partially cutaway side view showing a detail of a locking mechanism shown in FIG. 1.

In FIG. 6, a fixed shaft 17 is secured to the trigger bolt 16, and an engaging lever 18 is turnably and loosely fitted onto a fixed shaft 19 secured to the dead bolt 12 and has an engaging groove 20 formed at one end 18*a* for engaging with the fixed shaft 17. A permanent magnet 21 is slidably placed in a vertical direction in the dead bolt 12 and abuts with its upper part 21*a* on the other end 18*b* of the engaging lever 18. A locking lever 22 is turnably and loosely fitted onto a fixed shaft 23 secured to the case 4. The locking lever 22 locks by its one end 22*a* the upper end 16*a* of the trigger bolt 16 for locking the dead bolt 12, and has an engaging part 24 formed at its other end 22*b* for engaging with the engaging part 8*a* of the inner operating element 8. A spring 25 is mounted onto the fixed shaft 23 so as to keep the locking lever 22 up against the trigger bolt 16 by applying a force acting on said lever in an anti-clockwise direction. Namely, a locking means for locking the dead bolt 12 is composed of the trigger bolt 16, the locking lever 22 and the spring 25. A stopper 26 stops the movement of the dead bolt 12, and a spring 27 is secured at one end of the dead bolt 12 and at the other end to the case 4 used for holding the dead bolt 12 either in a locked position or in an unlocked position. The face plate 5 has an opening acting as pathway for the dead bolt 12.

Figure 7:
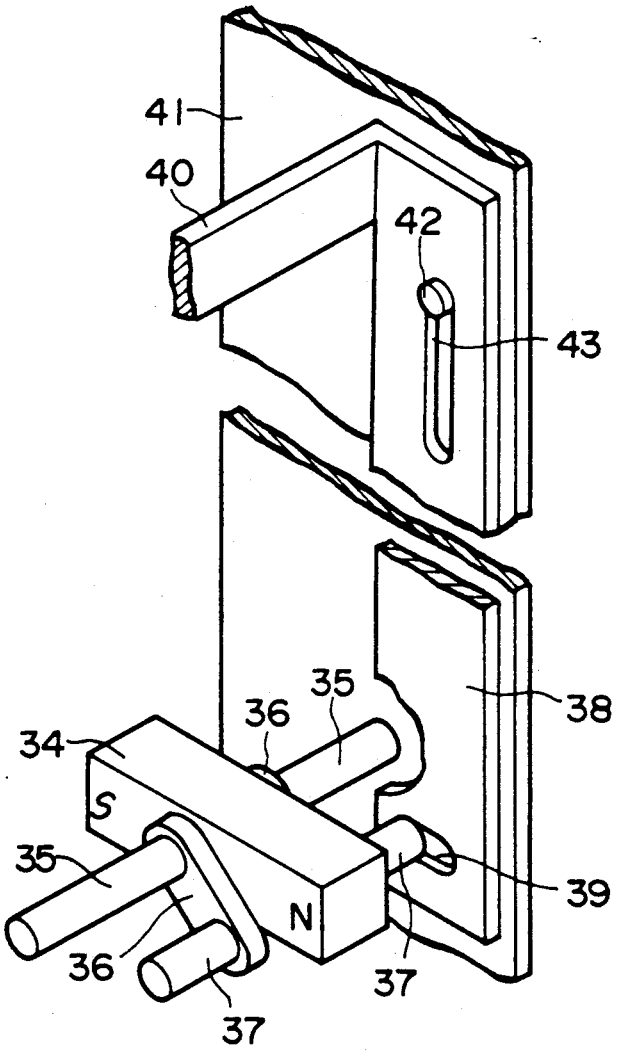
FIG. 7 is a perspective view showing a cooperating assembly in detail.

In FIGS. 1 and 2, the cooperating assembly portion B, mounted on the door's frame 2 includes a strike plate 31, a case 32, an opening 33 for receiving the dead bolt 12, a rotatable permanent magnet 34 which acts as a means for lifting the permanent magnet 21 of the dead bolt 12 and is unitarily mounted on a revolving shaft 35 as will be seen in detail in FIG. 7.

In FIGS. 1, 2 and 7, two turning levers 36 are unitarily fitted onto the revolution shaft 35 and provided with a guiding shaft 37 for slidably engaging at each end in an engaging slot 39 formed in the lower part of the actuating plate 38. A connecting plate 40 connects the actuating plates 38 at both sides, and two side plates 41, secured to a case 32, carry the revolution shaft 35 in their holes and are rotatably fitted therein. A guiding shaft 42 secured on the side plate 41 is slidably fitted in a slot 43 formed in the actuating plate 38. A solenoid 44 has a plunger 45 provided with a connecting plate 40. A spring 46 acts on the plunger 45 to extend it from the solenoid.

The operation of the device is as follows:

A case for unlocking the locking mechanism 3 from the outside while in a locked condition, as shown in FIG. 1, will be explained below. Refer to the attached drawings.

Figure 8:
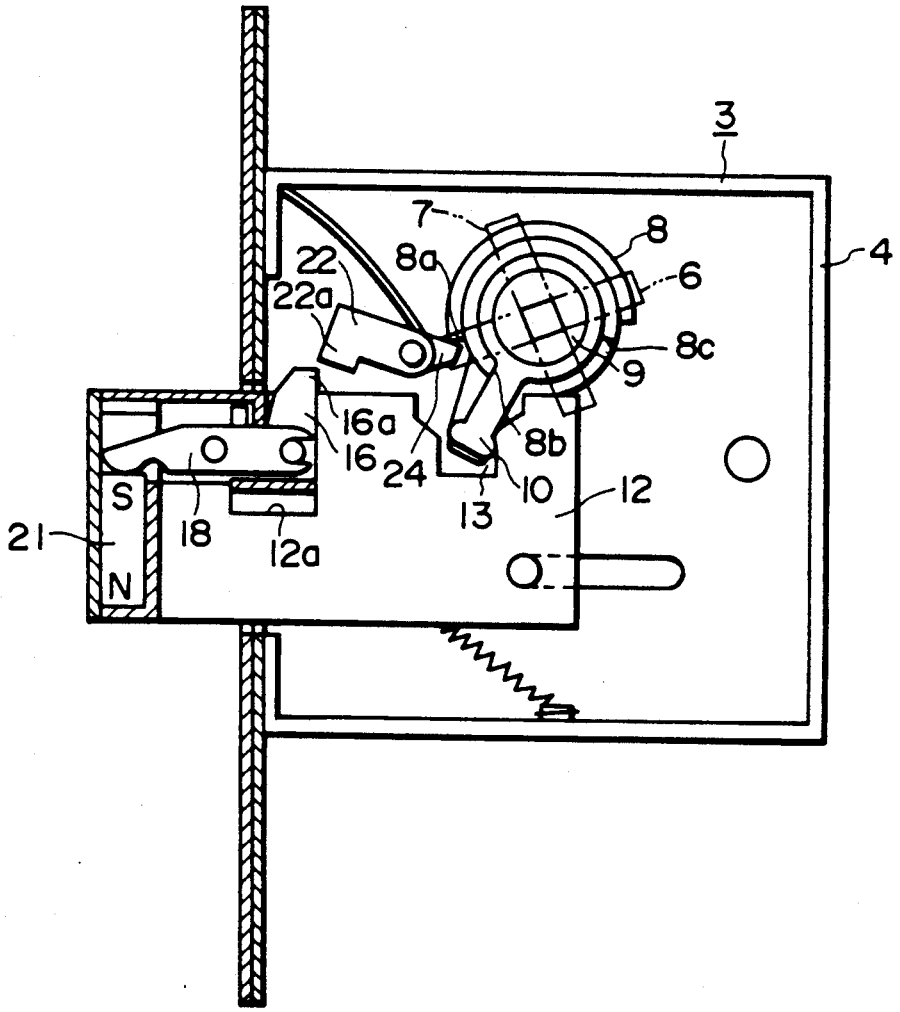
FIGS. 8, 9, 11 and 12 are partially cutaway sectional side views showing a locking mechanism in its operating condition.
Figure 9:
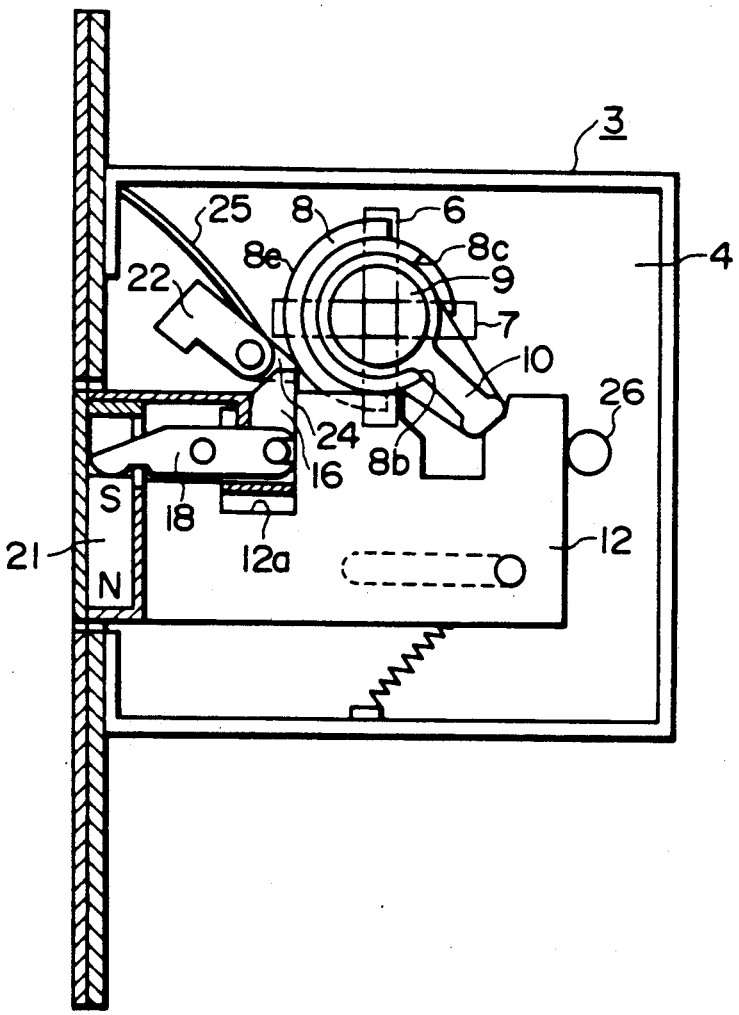

When the inside thumb-turn 6 is turned slightly in a clockwise direction, as seen from the inside, (and in a counter-clockwise direction as seen from the outside), the inner operating element 8 is turned, as seen in FIG. 8, to abut its engaging part **8*a* against the engaging finger 24 of the locking lever 22 which is swung in a clockwise direction, and, at the same time, disengages its one end 22*a* from the one end 16*a* of the trigger bolt 16. Further turning of the inside thumb-turn 6 causes the engaging part 8*a* of the operating element 8 to engage the turning lever 10 and urges the turning lever 10, which acts on the outer operating element 9, to swing and thereby retract the dead bolt 12 into the recess of the locking mechanism 3. The lock is now unfastened as shown in FIG. 9. Since the engaging finger 24 abuts onto the circumference 8*e* of the inner operating element 8, it can remain in the disengaged position from the trigger bolt 16**.

In the case of fastening the locking mechanism 3 from the inside, having been unfastened from the inside as shown in FIG. 9, the turning of the thumb-turn 6 in a counterclockwise direction, as seen from the inside, (in a clockwise direction as seen from the outside) makes the inner operating element 8 turn and urge by its engaging part **8*c* the turning lever 10 which, as the outer operating element 9 turns, slides the dead bolt forward to the locking position. At the same time, the engaging finger 24 of the locking lever 22 moves away from the circumference 8*e* of the outer operating element 8 and is returned by the force of the spring 25 into the position shown in FIG. 6 for locking the trigger bolt 16. In the case of fastening the locking mechanism 3 from the outside, having been unfastened from the inside, the outside thumb-turn 7 is turned in a clockwise direction, thereby the turning lever 10 moves to abut against the engaging part 8*b* of the inner operating element 8 and then to slide the dead bolt 12 forward into a fastened position by pushing the inner operating element 8**.

A case for unfastening the locking mechanism 3 from the outside is described as follows:

In this case the locking mechanism assembly 3 cannot be unfastened by turning the outside thumb-turn 7 only in a counter-clockwise direction. Even when the turning lever 10 reaches the position shown by the two-dot chain line in FIG. 6, the one end **16*a* of the trigger bolt 16 is still locked by the one end 22*a* of the locking lever 22 thereby not allowing the retraction of the dead bolt. Namely, the turning of the outer operating element 9 from the position shown by a solid line to the position shown by a two-dot chain-line does not cause the movement of the inner operating element 8 which remains in the position shown in FIG. 6. Consequently, the locking lever 22 is not moved by the engaging part 8*a* of the inner operating element 8, so the locking mechanism cannot be released from the outside by using only the outside thumb-turn 7**.

Accordingly, in the case of unlocking the above-mentioned locking mechanism from the outside it is necessary to make the trigger bolt disengage by remotely controlling the electric magnetic components of the lock device from a control room (not shown).

When the solenoid 44 is energized with current supplied by the usual remote control means in the control room, the plunger 45 is drawn upward by the solenoid 44 energized. Therefore the guide shaft 37, through the actuating plate 38, is moved upward to turn the turning lever 36 counter-clockwise about the turning shaft 35. Accordingly, the permanent magnet 34 is also turned in a counter-clockwise direction to the position shown in FIG. 10. Since the permanent magnet 34, in the door frame, approaches the permanent magnet 21 of the dead bolt 12 both facing same poles and repulsing to each other, the permanent magnet 21 of the dead bolt 12 moves up to the position shown in FIG. 11 to push upward the other end **18*b* of the engaging lever 18 which is therefore turned in a clockwise direction and acts on the fixed shaft 17 to lower the trigger bolt 16 resulting in the disengaging of one end 16*a* of the trigger bolt 16 from the end 22*a* of the locking lever 22**.

Consequently, since the trigger bolt 16 is now free from the locking lever 22 and can be moved by means of the outer operating element 9, the locking mechanism 3 can be brought into the unfastened position shown in FIG. 12 by turning the outside thumb-turn 7. In this case, the inner operating element 8 does not move and remains in its initial position.

In case of locking the locking mechanism 3 from the outside, after having been unfastened from the outside, the outside thumb-turn 7 is turned in a clockwise direction as seen from the outside in FIG. 12 so as to force the outer operating element 9 to turn the turning lever 10, which in turn moves the dead bolt 12 forward to the fastened position shown in FIG. 1. At the same time, the locking lever 22 is turned in a clockwise direction with one end **22*a* being lifted by the end 16*a* of the trigger bolt 16**.

In the case of locking from the inside the locking mechanism 3, having been unfastened from the outside, the inside thumb-turn 6 is turned in a counterclockwise direction as seen from the inside in FIG. 12 (in a clockwise direction as seen from the outside) so that the inner operating element 8 moves and urges by its engaging part 8c the turning lever 10 which, together with the outer operating element 9, is turned to bring the dead bolt into a locked position in the same way as mentioned above.

It is also possible to energize from the remote control room the solenoid 44 for only a predetermined time (for example, 10 sec.) limited by a timer, within which unlocking is allowed from the outside. When the power supply is turned off, the actuating plate 38 is pushed down by the action of the coil spring 46 and thereby the permanent magnet 34 is turned in a clockwise direction to get its pole away from the permanent magnet 21 of the dead bolt 12. Consequently, the permanent magnet 21 is lowered and the dead bolt is brought into a fastened position.

Figure 13:
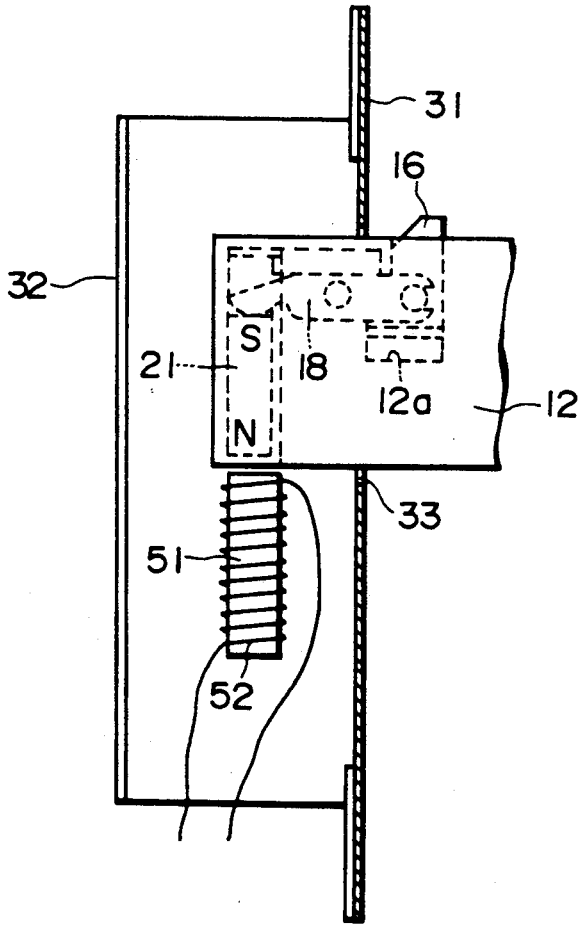
FIG. 13 a sectional side view showing another construction of the cooperating assembly of FIGS. 1 and 2.

FIG. 13 is a sectional side view showing the modified form of the striking side (i.e. the cooperating assembly in the door frame 2 of FIG. 2). The difference from the assembly shown in FIG. 2 is that an electromagnet 51 is used instead of the permanent magnet 34 used in the door frame 2. In this case it is possible to move the permanent magnet 21 of the dead bolt 12 up through the repulsing action of same poles when the solenoid 52 of the electromagnet 51 is energized.

In the case when the locking device, according to the present invention, is applied to a door lock of a distribution board, a locker or the like, it is possible to remove the inside thumb-turn 6 and the inner operating element 8 since the above-mentioned door does not require the locking/unlocking function from the inside but does require the locking/unlocking function from the outside only by using the outside thumb-turn 7 and the outer operating element 9.

Furthermore, power to the solenoid 44 or the coil of the electromagnet 51 may be supplied not only by the operator in the remote control room, but also automatically when a person has a programmed magnetic card and passes it through an electronic card reader or if he inputs a password on a Ten-keyboard and thus into a computer.

Figure 10:
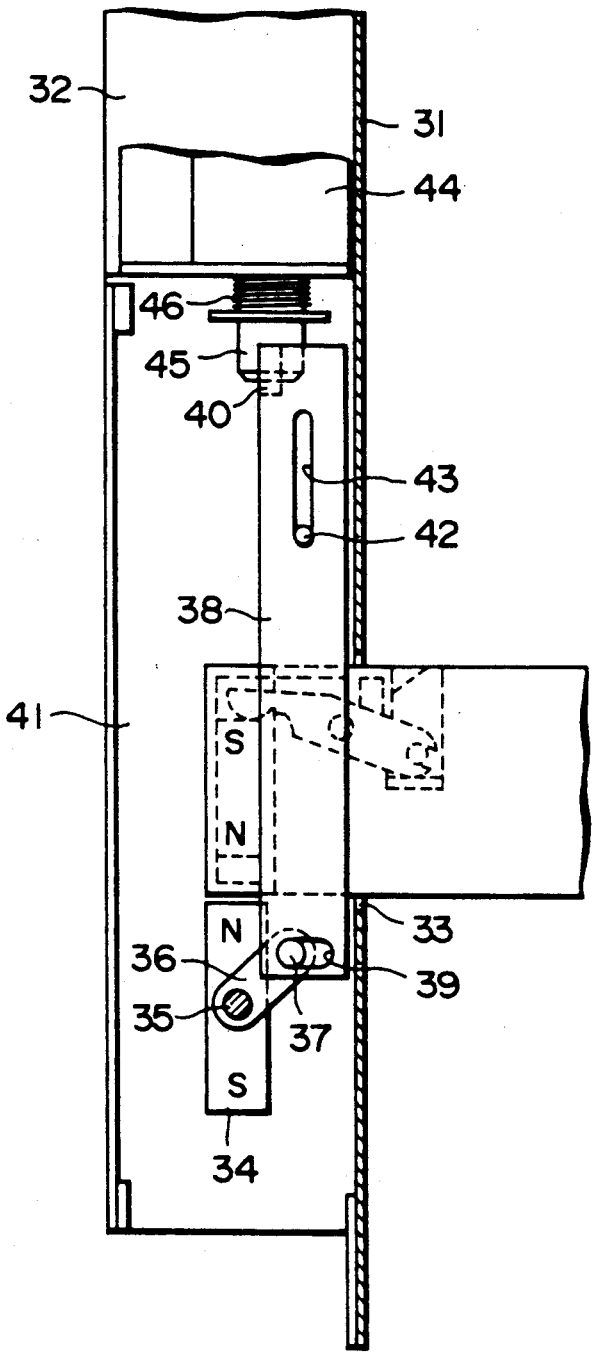
FIG. 10 is a sectional side view showing a cooperating assembly in its operating condition.
Figure 11:
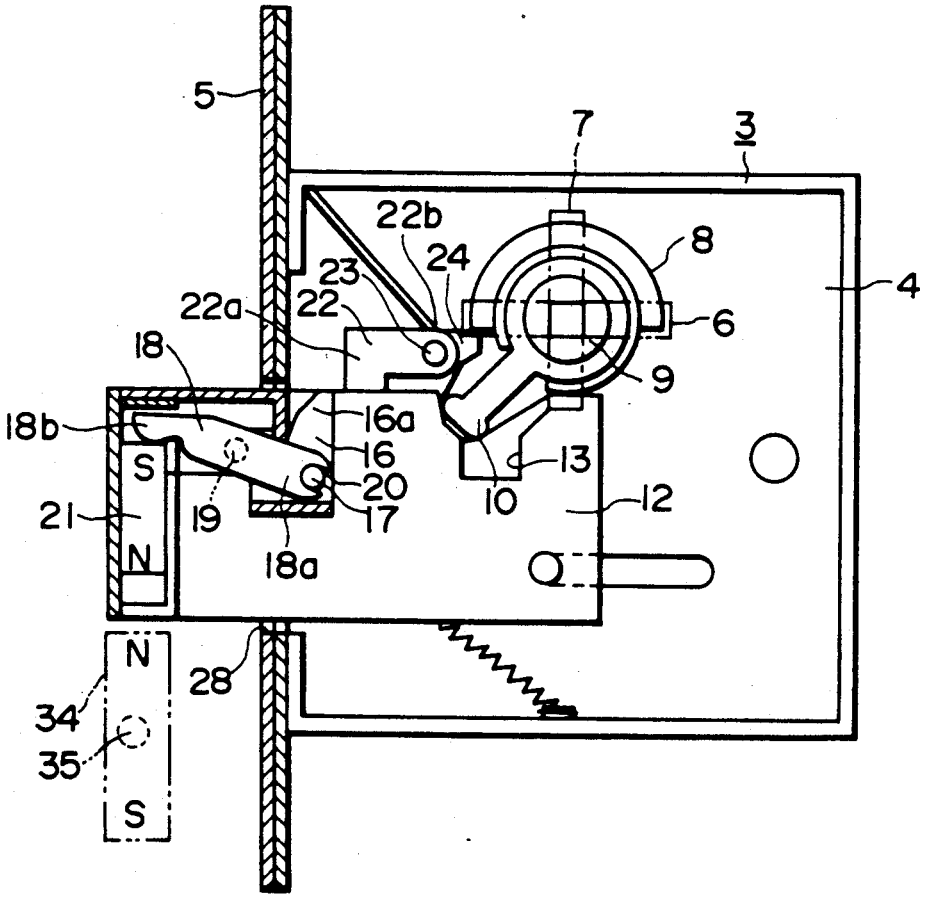

However in the above-described embodiment the unlocking from the outside by means of the outside thumb-turn 7 is achieved only after releasing the trigger bolt 16 by energizing the solenoid 44 shown in FIG. 10 or the coil 52 shown in FIG. 13. It is also possible to construct the locking device in order to be unlocked by a key.

Namely, a key-turned cylinder mechanism is mounted on the inside of the outside thumb-turn 7, the partition plate 11 shown in FIG. 4(*c*) is removed or an opening corresponding to the opening **8*d* of the inner operating element 8 is formed therein, and the opening 9*a* of the outer operating element 9 is enlarged in its diameter so it is somewhat larger than the opening 8*a* of the inner operating element 8. When the key is inserted in the cylinder to tightly fit its blade tip in the opening 8*d* and is then turned, the inner operating element 8 is turned to release the trigger bolt 16 from the turning lever 10. Since, at the same time, the outer operating element 9 becomes turnable, further turning of the key causes the same unlocking motion of the turning lever 10 as described above in the case for unlocking by turning the inside thumb-turn 6**. This modified embodiment is convenient to use because it additionally allows the unlocking from the outside by using a key.

As is apparent from the foregoing description, since the locking device, according to the present invention, comprises a locking mechanism assembly placed in a door, wherein a lock case includes therein two turnable operating elements, inner one of which can be operated from the inside by means of an inside thumb-turn and the other outer which can be operated from the outside by means of an outside thumb-turn, a turning lever drivable by an outer operating element, a dead bolt operable by a turning lever for moving said bolt forward to lock and backwards to release, an engaging means for locking the dead bolt in the locking position, and a turning means which can be turned by an inner operating element to release the engaging means and then to turn the turning lever; and a cooperating assembly carried in the door frame, wherein a strike plate in the door frame includes a means for disengaging the trigger bolt from the locking lever by retracting said trigger bolt into the dead bolt, it may be simple in construction, small in size and, therefore, inexpensive to manufacture. The locking device according the present invention may be suitably used for locking the door of a distribution board, a locker etc.

Furthermore, it may be used for entrance and exit doors. There is no fear of illegally unlocking the locking device, since the device cannot be unlocked from the outside by using a thumb-turn only.

I claim:

1. A locking device comprising:

a locking mechanism assembly disposed in a door, said locking mechanism assembly comprising a lock case which includes a turnable operating means provided with an inside thumb-turn operable from the inside and an outside thumb-turn operable from the outside, a turning lever drivable by said operating means, a dead bolt movable forward to lock and backwards to unlock by the action of said turning lever, and a locking means for locking said dead bolt in a locking position, said locking means being releasable by turning said operating means for unlocking said dead bolt by turning said inside thumb-turn, said locking means being remotely releasable so as to allow movement of said turning lever for unlocking said dead bolt by using said outside thumb-turn;

said locking means comprising a trigger bolt movable in and out of said dead bolt, a locking lever for locking said dead bolt when said trigger bolt extends outwardly from said dead bolt, and a spring means for holding said locking lever against said trigger bolt; and a component assembly disposed in a door frame which cooperates with said locking mechanism assembly an the door and which comprises an electrical means remotely operable to release said locking means.

2. A locking device as described in claim 1, wherein said dead bolt includes an engaging lever for engaging said trigger bolt and a permanent magnet for actuating said engaging lever, said permanent magnet being remotely displaceable to move said engaging lever for retracting said trigger bolt into said dead bolt and thereby releasing said locking means.

3. A locking device as described in claim 1, wherein said locking means is releasable from the inside by turning said inside thumb-turn which causes said operating means to move said locking lever for releasing said trigger bolt and then to engage said turning lever for retracting said dead bolt in an unlocking direction.

4. A locking device as described in claim 1, wherein the lock is unlockable from the outside by remotely releasing said locking means to retract said trigger bolt into said dead bolt and then by further turning said outer thumb-turn to force said operating means to move said turning lever for retracting said dead bolt in the unlocking direction.

5. A locking device as described in claim 1, wherein said electrical means comprises a solenoid and a permanent magnet movable by the action of said solenoid, said solenoid being electrically energized from a distance to displace said permanent magnet opposite to another permanent magnet disposed in said dead bolt, whereby said other permanent magnet is displaced to release said locking lever from the locking state.

6. A locking device as described in claim 1, wherein said electrical means comprises an electromagnet placed in the door frame, and further comprising a permanent magnet on said lock case, said electromagnet being electrically energized from a distance for displacing said permanent magnet in said dead bolt to release said locking lever.

7. A locking device as described in claim 1, wherein switching-on of said solenoid is effected by passing a card through a card reader.

8. A locking device as described in claim 5, wherein switching-on of said solenoid is effected by inputting a specified input into a key board.

9. A locking device as described in claim 6, wherein switching-on of said electromagnet is effected by passing a card through a card reader.

10. A locking device as described in claim 6, wherein switching-on of said electromagnet is effected by inputting a specified input into a key board.

* * * * *